US005779004A

United States Patent [19]

Hoshino et al.

[11] Patent Number: 5,779,004

[45] Date of Patent: Jul. 14, 1998

[54] LUBRICATING MECHANISM FOR PISTON TYPE COMPRESSOR

[75] Inventors: Tatsuyuki Hoshino; Kenji Takenaka, both of Kariya, Japan

[73] Assignee: Kabushiki Kaisha Toyoda Jidoshokki Seisakusho, Kariya, Japan

[21] Appl. No.: 633,504

[22] Filed: Apr. 17, 1996

[30] Foreign Application Priority Data

Apr. 18, 1995 [JP] Japan ..... 7-092735

[51] Int. Cl.[6] ..... F01M 1/00

[52] U.S. Cl. ..... 184/6.17; 92/71; 92/154; 91/499; 74/60; 417/269

[58] Field of Search ..... 92/71, 12.2, 154; 91/499; 74/60; 417/269; 184/6.17

[56] References Cited

U.S. PATENT DOCUMENTS

| | | | |
|---|---|---|---|
| 3,557,664 | 1/1971 | Akaike et al. | 91/499 |
| 3,888,604 | 6/1975 | Oshima et al. | 417/269 |
| 3,955,899 | 5/1976 | Nakayama et al. | 417/269 |
| 3,999,893 | 12/1976 | Kishi | 417/269 |
| 4,005,948 | 2/1977 | Hiraga et al. | 417/269 |
| 4,127,363 | 11/1978 | Kato et al. | 184/6.17 |
| 4,221,544 | 9/1980 | Ohta | 417/269 |
| 4,326,838 | 4/1982 | Kawashima et al. | 417/269 |
| 4,401,414 | 8/1983 | Ishizuka | 417/269 |
| 5,062,773 | 11/1991 | Kawai et al. | 417/269 |
| 5,518,374 | 5/1996 | Ota et al. | 417/222.2 |

FOREIGN PATENT DOCUMENTS

| | | |
|---|---|---|
| 0040474 | 11/1981 | European Pat. Off. . |
| 2287598 | 5/1976 | France . |
| 2303969 | 10/1976 | France . |

*Primary Examiner*—Thomas E. Denion

*Attorney, Agent, or Firm*—Brooks Haidt Haffner & Delahunty

[57] ABSTRACT

A lubricating mechanism for a piston type compressor in a refrigeration system. A cam plate is mounted on a drive shaft for integral rotation therewith in a crank chamber, which is defined in a casing. Pistons are coupled to the cam plate and reciprocate in cylinder bores extending parallel to the drive shaft. Each piston compresses refrigerant gas containing lubricating oil mist and discharges the compressed refrigerant gas from the compressor during rotation of the cam plate. The refrigerant gas is supplied into the crank chamber and is circulated in the casing. The lubricating oil is supplied to various moving parts from a location near the drive shaft. An oil pan is provided outside and to the side of the casing for collecting lubricating oil. A recovering passage connects the oil pan with the crank chamber to convey the lubricating oil from the crank chamber to the oil pan for collection. A guide passage guides the lubricating oil collected in the oil pan to the location near the drive shaft using gravitational force. By mounting the oil pan on the side of the casing, the oil pan collects relatively less liquefied refrigerant and more oil, and thus improves lubrication of the compressor.

17 Claims, 6 Drawing Sheets

LUBRICATING MECHANISM FOR PISTON TYPE COMPRESSOR

BACKGROUND OF THE INVENTION

1. Field of the Invention

The present invention relates to a piston type compressor, and more particularly, to a lubricating mechanism for the interior of a piston type compressor.

2. Description of the Related Art

A typical compressor that compresses and discharges refrigerant gas by reciprocating pistons includes a cam plate, such as a swash plate or a wave cam. The cam plate, which is arranged in a crank chamber, is mounted on a drive shaft and operably coupled to pistons by shoes. This structure enables the cam plate to rotate integrally with the drive shaft at a high rotation speed. The rotation of the drive shaft is thus converted to reciprocation of the pistons.

A swash plate type compressor is typically provided with a lug plate which is connected to the swash plate by a hinge member, and shoes that slide with respect to the swash plate. The hinge member causes sliding between the swash plate and the lug plate. Such sliding results in a need for lubrication. Friction, caused by insufficient lubrication, may lead to unsatisfactory operation of the compressor. To prevent this, various parts are lubricated by lubricating oil suspended in the refrigerant gas. The lubricant oil is collected in an oil pan and then supplied to the crank chamber. The oil circulates in the compressor in this manner.

Japanese Unexamined Utility Model Publication 55-123679 published on Sep. 2, 1980 and filed on Feb. 26, 1979 describes such a compressor. The compressor has an oil 102 located at the bottom of its casing 101. Lubricating oil is drawn into a crank chamber 106 from the oil pan 102 through an oil passage 105 by a trochoid pump 104, which is operated synchronously with a drive shaft 103.

In this compressor, when the operation of the compressor is stopped, the refrigerant gas liquefies and collects in the crank chamber 106. However, since the oil pan 102 is located at the bottom of the casing 101, gravitational force causes the liquefied refrigerant to flow into the oil pan 102. The large specific gravity of the liquefied refrigerant causes the refrigerant to subside below the lubricating oil and collect at the bottom of the oil pan 102. Since the oil passage 105 is connected with the lower section of the oil pan 102, only the liquefied refrigerant collected at the bottom of the oil pan 102, is drawn into the crank chamber 106 when operation of the compressor is commenced. The liquefied refrigerant washes away the lubricating oil adhered to the sliding and rotating parts in the compressor. As a result, a temporary lubrication deficiency may result in excess friction and may cause a deterioration of the sliding parts within the compressor.

To prevent this, the oil passage 105 may be connected to the upper section of the oil pan 105. However, such a structure would not draw lubricating oil from the oil pan 102 when the amount of collected oil is small. This may also cause excess friction among the various sliding parts inside the compressor.

Additionally, the increase in the number of cylinder bores in recent compressors has resulted in a larger compression reaction applied to the pistons. The reaction force also acts on the drive shaft. Thus, lubrication and cooling of the rotating parts and the sliding parts that are arranged around the drive shaft has become more significant. For example, in a variable displacement type compressor, which employs single-headed pistons, it is required that the pressure in a crank chamber be accurately adjusted to adjust the displacement. Therefore, the crank chamber is sometimes disconnected from an external refrigerant circuit. Accordingly, lubricating oil is supplied into the crank chamber only when lubricating oil mist is conveyed through the blowby gas from compression chambers and when refrigerant and oil are drawn in during pressure adjustment of the crank chamber. When the compressor is shifted to maximum displacement operation from minimum displacement operation, the refrigerant gas in the crank chamber is discharged into the suction chamber. This causes much of the lubricating oil in the crank chamber to be removed. This may cause insufficient lubrication of various parts.

Furthermore, bearings and seals are provided on the opposite side of the lug plate with respect to the crank chamber. Thus, the large lug plate may obstruct lubricating oil from reaching the bearings and seals and may result in insufficient lubrication and cooling of the bearings and seals.

SUMMARY OF THE INVENTION

It is a main objective of the present invention to provide a piston type compressor that maintains satisfactory lubrication of the parts in the crank chamber and thus increases the life of the compressor.

It is another objective of the present invention to provide a piston type compressor that includes an oil pan that may easily be produced.

To achieve the foregoing and other objects and in accordance with the purpose of the present invention, a compressor for a refrigerator system that circulates a refrigerant mixed with oil includes a housing, a crank chamber, a drive shaft, a cam plate, a cylinder bore, a piston, an oil pan, an oil recovering passage, and an oil guide passage. The crank chamber is defined within the housing and has a wall. The mixture of refrigerant and oil is supplied to the crank chamber. The crank chamber has a bottom at which liquefied refrigerant and oil may settle due to gravity under certain conditions. The drive shaft is mounted in a rotatable manner to the housing for driving the compressor. The cam plate is connected to and driven by the drive shaft and located within the crank chamber. Rotation of the cam plate throws oil against the wall and causes oil to flow along the wall of the crank chamber in the general direction of rotation of the cam plate during operation of the compressor. The cylinder bore is formed within the housing. The piston is located within the bore and is coupled to the cam plate such that the cam plate causes the piston to reciprocate within the bore, which serves to compress the refrigerant and to discharge the refrigerant and oil mixture from the compressor. The oil pan is connected to and communicate with the crank chamber for collecting oil from the crank chamber. The oil pan is located at a position elevated from the bottom of the crank chamber. The oil recovering passage joins the oil pan with the crank chamber such that some of the oil flowing along the wall of the crank chamber enters the recovering passage and thus enters the oil pan. The oil guide passage guides oil from the oil pan toward a location near the drive shaft by the force of gravity on the oil.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS (First Embodiment)

A first embodiment according to the present invention will now be described with reference to FIGS. 1 through 3. In this embodiment, a compressor has a drive shaft, which is connected to a drive source such as an automobile engine by an electromagnetic clutch. The present invention may also be embodied in a clutchless type compressor. Furthermore, although this embodiment employs a swash plate serving as a cam plate that converts the rotation of the drive shaft to linear piston motion, the present invention may also be embodied in a compressor that employs a wobble plate or a wave cam.

Figure 1:
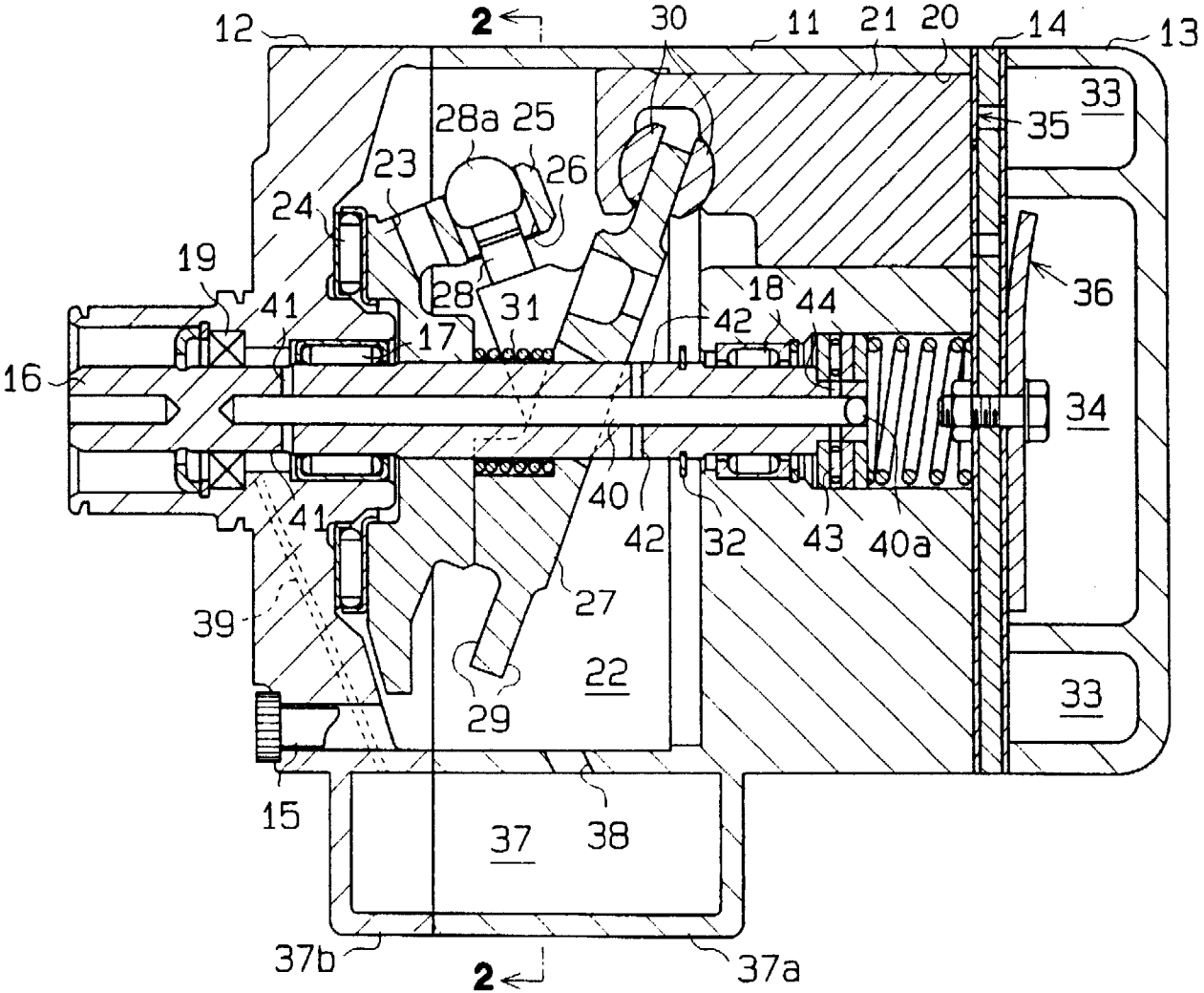
FIG. 1 is a cross-sectional top view a piston type compressor according to a first embodiment of the present invention.
Figure 2:
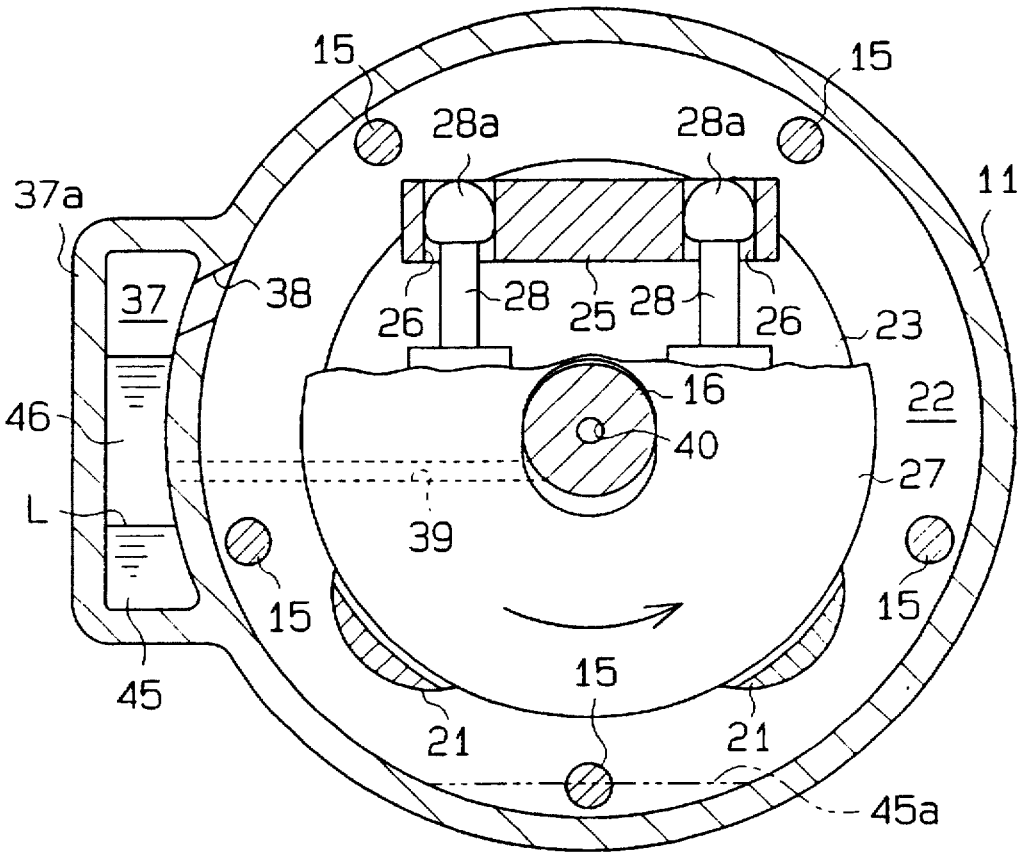
FIG. 2 is a cross-sectional view as seen from the plane indicated by line 2—2 in FIG. 1 showing the height of the liquid surface of lubricating oil collected in an oil pan.

As shown in FIGS. 1 and 2, a front housing 12 is directly coupled to the front end of a cylinder block 11 while a rear housing 13 is coupled to the rear end of the block 11 with a valve plate 14 provided in between. A plurality of through bolts 15 fasten the front and rear housings 12, 13 to the two ends of the block 11 thus forming a casing.

A drive shaft 16 is supported by a pair of radial bearings 17, 18 and a pair of thrust bearings 24, 43 in the block 11 and the front housing 12. A lip seal 19 is provided between the front end section of the shaft 16 and the front housing 12.

A plurality of cylinder bores 20 extending parallel to one another are formed in the block 11. A slidable single-headed piston 21 is accommodated in each bore 20. A crank chamber 22 is defined between the block 11 and the front housing 12.

A lug plate 23 is mounted on the shaft 16 in the crank chamber 22 and rotates integrally with the shaft 16. The front side of the lug plate 23 is supported near the inner surface of the front housing 12 by the thrust bearing 24. A support arm 25 projects from the lug plate 23. A pair of elongated guide holes 26 are formed at the distal end of the arm 25.

A substantially disk-shaped swash plate 27 is tiltably mounted on the shaft 16. A pair of connectors 28 project from the front side of the swash plate 27. A spherical body 28*a* is provided at the distant end of each connector 28. Each body 28*a* is engaged to one of the guide holes 26 in a manner such that it rotates and slides freely therein to enable the inclination of the swash plate 27 with respect to the lug plate 23.

A sliding surface 29 is defined on both front and rear sides of the swash plate 27 near the periphery of the plate 27. Each piston 21 is connected to the sliding surfaces 29 by a pair of semispherical shoes 20. Rotation of the drive shaft 16 rotates the swash plate 27 with the lug plate 23 and causes each piston 21 to reciprocate in the associated bore 20.

A spring 31 is provided between the lug plate 23 and the swash plate 27. The force of the spring 31 normally sustains the swash plate 27 at a minimum inclination position (the position of FIG. 3). A stopper 32 is provided on the shaft 16 to restrict the minimum inclination position of the swash plate 27.

A suction chamber 33 is defined in the rear housing 13 at its radially outer section. A discharge chamber 34 is defined in the rear housing 13 at its central section. A frontward movement of the pistons 21 in the associated bores 20 causes the refrigerant gas in the suction chamber 34 to be drawn into the bore 20 through a suction mechanism 35 provided in the valve plate 14. A rearward movement of the pistons 21 in the associated bores 20 causes the compressed refrigerant gas in the bore 20 to be discharged into the discharge chamber 34 through a discharge mechanism 36 provided in the valve plate 14. A lubricating oil mist is suspended in the refrigerant gas.

The rear housing 13 is provided with two displacement control valves (not shown). One of the control valves selectively opens and closes a gas intake passage (not shown), through which refrigerant gas containing lubricating oil mist is supplied from the discharge chamber 34 to the crank chamber 22. The other control valve selectively opens and closes a bleeding passage (not shown), which connects the crank chamber 22 with the suction chamber 33. These control valves adjust the difference between the crank chamber pressure Pc, which acts on the front side of the pistons 21, and the bore internal pressure Pb, which acts on the rear side of the pistons 21. As a result, the displacement of the compressor is controlled as the inclination of the swash plate 27 is adjusted to alter the stroke of the pistons 21. This structure is further described in pending U.S. patent application Ser. No. 08/438,386, which is hereby incorporated by reference.

An oil pan 37 is provided outside the casing extended over the joint between the block 11 and the front housing 12. The oil pan 37 is defined by a wall 37*a* formed on the block 11, a wall 37*b* formed on the front housing 12, and the outer walls of the block 11 and the front housing 12.

An oil recovering passage, or aperture 38, extends through the block 11 connecting the crank chamber 22 with the oil pan 37. The aperture 38 is arranged extending downward from the crank chamber 22 to the oil pan 37 as seen in FIG. 2. This enables the lubricating oil mist suspended in the refrigerant gas to easily flow into the oil pan 37 from the crank chamber 22 during rotation of the swash plate 27.

As shown in FIG. 1, a space is defined around the shaft 16 between the radial bearing 17 and the lip seal 19 in the front housing 12. An oil guide passage, or first lubricating passage 39, extends straight through the wall of the front housing 12, horizontally, and connects the space with the oil pan 37. As shown in FIG. 2, the cross-sectional area of the passage 39 is smaller than that of the aperture 38. The first end of the passage 39 is connected to the oil pan 37 at a position above the maximum liquid level L of the liquefied refrigerant 45 collected in the pan 37. The second end of the passage 39 is connected to the space at a position above the bottom of the shaft 16.

As shown in FIG. 1, an oil supply passage, or second lubricating passage 40, extends in the shaft 16 along its axis. A first hole 41 connects the passage 40 with the vicinity of the front end of the radial bearing 17. A second hole 42, located near the swash plate 27, connects the passage 40 with the crank chamber 22. A third hole 44 connects the passage 40 to the vicinity of the thrust bearing 44. The rear end of the passage 40 is closed by a plug 40*a*.

Figure 3:
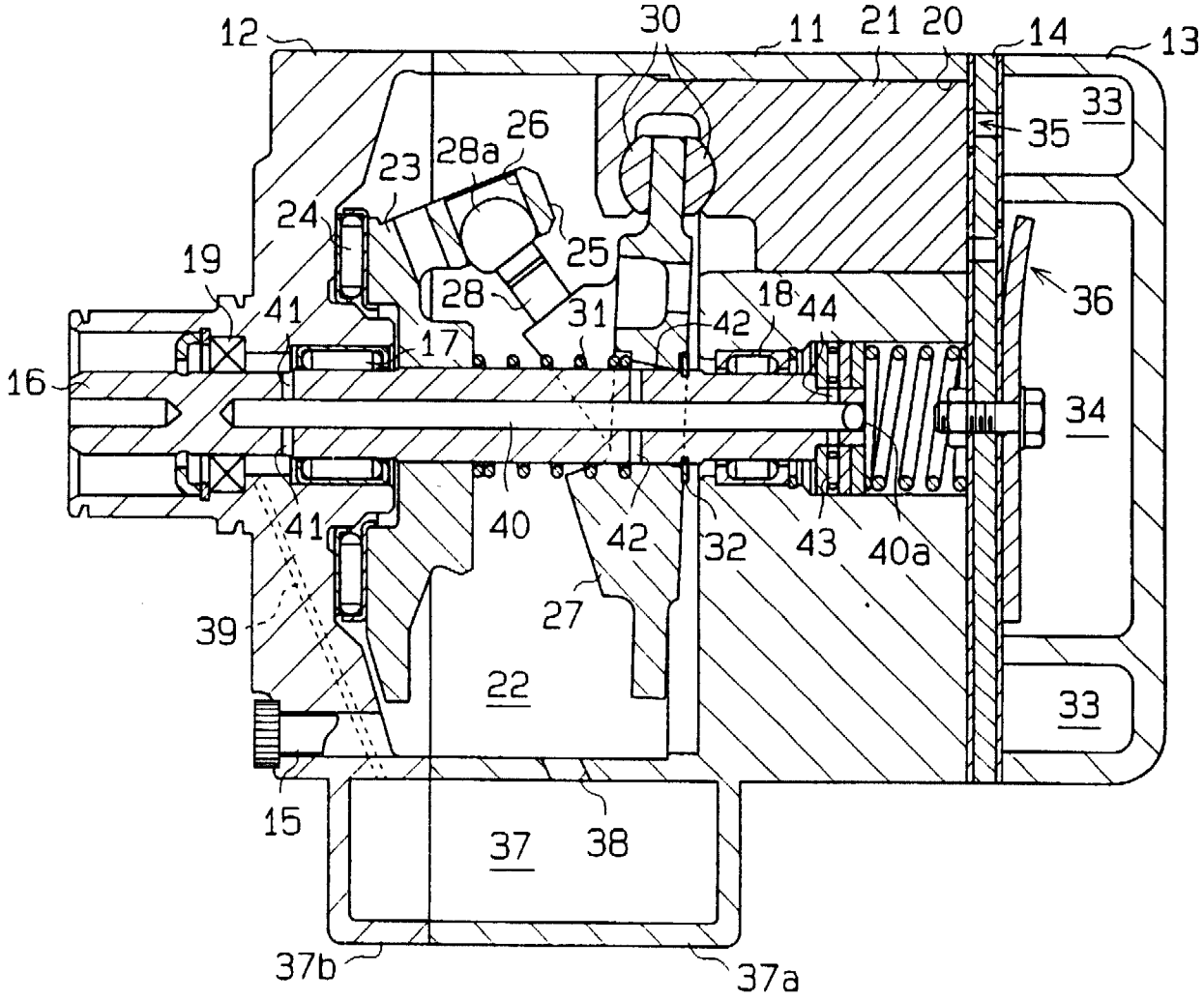
FIG. 3 is a cross-sectional top view of the compressor in FIG. 1 showing the swash plate arranged at the minimum inclination position.

The compressor displacement is very small in the state illustrated in FIG. 3. In this state, the force of the spring 31 acts on the swash plate 27 and sustains it at the minimum inclination position, where the swash plate 27 is restricted by the stopper 32. When the shaft 16 is rotated by the engine's drive force in this state, the lug plate 23 rotates the swash plate 27 and reciprocates each piston 21 at a minimum stroke. This causes a minimum volume of refrigerant gas to be drawn into each bore 20, compressed and then discharged into the discharge chamber 34.

The preferred use of the present compressor is for compressing refrigerant in a vehicle air conditioning system. When the temperature in the passenger compartment increases, that is, when the cooling load is high, the suction pressure increases and causes a decrease in the difference between the pressure Pb in the bores 20, which acts on the rear side of the pistons 21, and the pressure Pc in the crank chamber 22, which acts on the front side of the pistons 21. This causes an increase in the moment acting to increase the inclination of the swash plate 27. As the inclination of the swash plate 27 approaches the position shown in FIG. 1, the displacement of the compressor increases.

When the temperature in the passenger compartment is low, the cooling load is reduced. Thus, the pressure inside the suction chamber 33 decreases and causes an increase in the difference between pressures Pc and Pb. This reduces the inclination of the swash plate 27 and decreases the stroke of the pistons 21. As a result, the displacement of the compressor becomes small. As described above, the displacement of the compressor is also controlled by altering the pressure difference through the adjustment of the pressure in the crank chamber 22 using the displacement control valves (not shown) and thus altering the pressure difference.

The lubrication of the compressor will now be described. Lubricating oil mist, suspended in the refrigerant gas that flows into the crank chamber 22 from the discharge chamber 34, adheres to the swash plate 27 and other parts. When the operation of the compressor is stopped, the lubricating oil adhered to the swash plate 27 and other parts falls and collects into a pool 45*a* along with liquefied refrigerant gas at the bottom of the crank chamber 22. When the compressor commences operation, the liquefied lubricating oil 45*a* is diffused by the rotation of the swash plate 27. The resulting lubricating oil mist is applied to the sliding surfaces 29 and the shoes 30. The centrifugal force produced during rotation of the lug plate 23 and the sash plate 27 sprays the oil mist on the walls of the crank chamber 22. The lubricating oil is moved along the crank chamber walls by the flow of gas produced when the swash plate 27 rotates and is recovered in the oil pan 37 through the aperture 38.

Since most of the refrigerant is gasified when the swash plate 27 is rotated, essentially only the oil mist, which has a greater specific gravity than the refrigerant gas, is sent toward the inner walls. Thus, only a small amount of liquefied refrigerant enters the oil pan 37 through the aperture 38. Due to this structure, the compressor according to the present invention is advantageous in comparison with the prior art compressors. The side-mounted oil pan 37 of the present compressor collects relatively less liquefied refrigerant in the oil pan 37. Thus, liquefied refrigerant is not supplied to the shaft 16, and the position where the first lubricating passage 39 opens into the oil pan 22 may be lowered. Therefore, the lubricating oil in the oil pan 37 is constantly supplied into the crank chamber 22 without being affected by the amount of the oil in the pan 37.

The lubricating oil 46 recovered in the oil pan 37 is supplied to the space defined between the radial bearing 17 and the lip seal 19 by gravitational force through the first lubricating passage 39. The oil lubricates and cools the lip seal 19 and the radial bearing 17. The oil then flows toward the thrust bearing 24 through the openings of the radial bearing 17, lubricates the thrust bearing 24, and returns to the bottom of the crank chamber 22. In this manner, lubricating oil is directly supplied to the bearings 17, 24 and the lip seal 19. Thus, these members 17, 19, 24 are satisfactorily lubricated and cooled, and their durability and reliability is improved.

Some of the lubricating oil supplied to the shaft 16 through the first lubricating passage 39 is conveyed through the first hole 41, the second lubricating passage 40, and the second hole 42 to a position near the swash plate 27 and the shoes 30 in the crank chamber 22. The centrifugal forces produced by the rotation of the shaft 16 sends the oil toward the walls of the casing. As the oil advances toward the walls, the swash plate 27, the sliding surfaces 29, and the shoes 30, which require lubrication the most, and which are arranged between the shaft 16 and the casing, are directly lubricated. Therefore, insufficient lubrication of the swash plate 27 and the shoes 30 is prevented. This reduces friction between the swash plate 27 and the shoes 30 and enhances the reliability of the compressor.

In addition, some of the lubricating oil in the second lubricating passage 40 flows through the third hole 44 and lubricates the rear thrust bearing 43 and radial bearing 18. Hence, the bearings 43, 18 are directly provided with the oil and satisfactorily lubricated. This improves the durability and reliability of the bearings 43, 18.

As described above, the lubricating oil 46 collected in the oil pan 37 is supplied to the shaft 16 through the first lubricating passage 39 by gravitational force. Therefore, lubricating oil is supplied from the oil pan 37 without providing a pump in the lubricating passages. As a result, the structure of the compressor is simple.

The aperture 38, which serves as an inlet of the oil pan 37, is formed having a large diameter. This enables the lubricating oil to easily flow into the oil pan 37. Contrarily, the first lubricating passage 39, which serves as an outlet of the oil pan 37, is formed having a small diameter. This prevents an excessive flow of lubricating oil. Therefore, the lubricating oil is easily collected in the oil pan 37 and the collected oil flows out of the pan 37 gradually. This structure prevents the oil pan 37 from running out of lubricating oil.

Since the oil pan 37 is defined spanned over the block 11 and the front housing 12, molding the oil pan 37 from die cast, or the like, is simple. In addition, the first lubricating passage 39 in the front housing 12 can be drilled from the inside of the oil pan 37 at the front housing 12 side. Therefore, manufacturing the compressor is relatively simple.

Refrigerant gas liquefies when the operation of the compressor is stopped for a long period of time. This may result in the existence of liquefied refrigerant in the oil pan 37. The specific gravity of the liquefied refrigerant 45 being greater than the lubricating oil 46 causes the refrigerant 45 to subside below the oil 46 and collect at the bottom of the oil pan 37, as shown in FIG. 2. In the compressor according to the present invention, the first lubricating passage 39 is connected to the oil pan 37 at a position above the maximum liquid level L of the liquefied refrigerant 45. Therefore, when the compressor commences operation, only the lubricating oil 46 is supplied into the crank chamber 22. This allows efficient lubrication and cooling of the rotating parts and the sliding parts. The liquefied gas that is collected at the bottom of the oil pan 37 will vaporize by the pressure fluctuation and temperature increase in the crank chamber 22.

If the first lubricating passage 39 were connected with the bottom of the oil pan 37, as in the prior art, liquefied refrigerant would be supplied to the shaft 16 when the operation of the compressor is commenced. such liquefied refrigerant washes away the lubricant oil adhered to the rotary and sliding parts. This may cause insufficient lubrication of the compressor.

The structure of the above compressor constantly lubricates and cools the rotating and sliding parts during operation of the compressor. Thus, insufficient lubrication in the crank chamber 22 is prevented even during minimum displacement operation, in which the amount of circulating lubricating oil is small. Therefore, this structure is advantageous when applied to clutchless type compressors, which are constantly operated.

(Second Embodiment)

Figure 4:
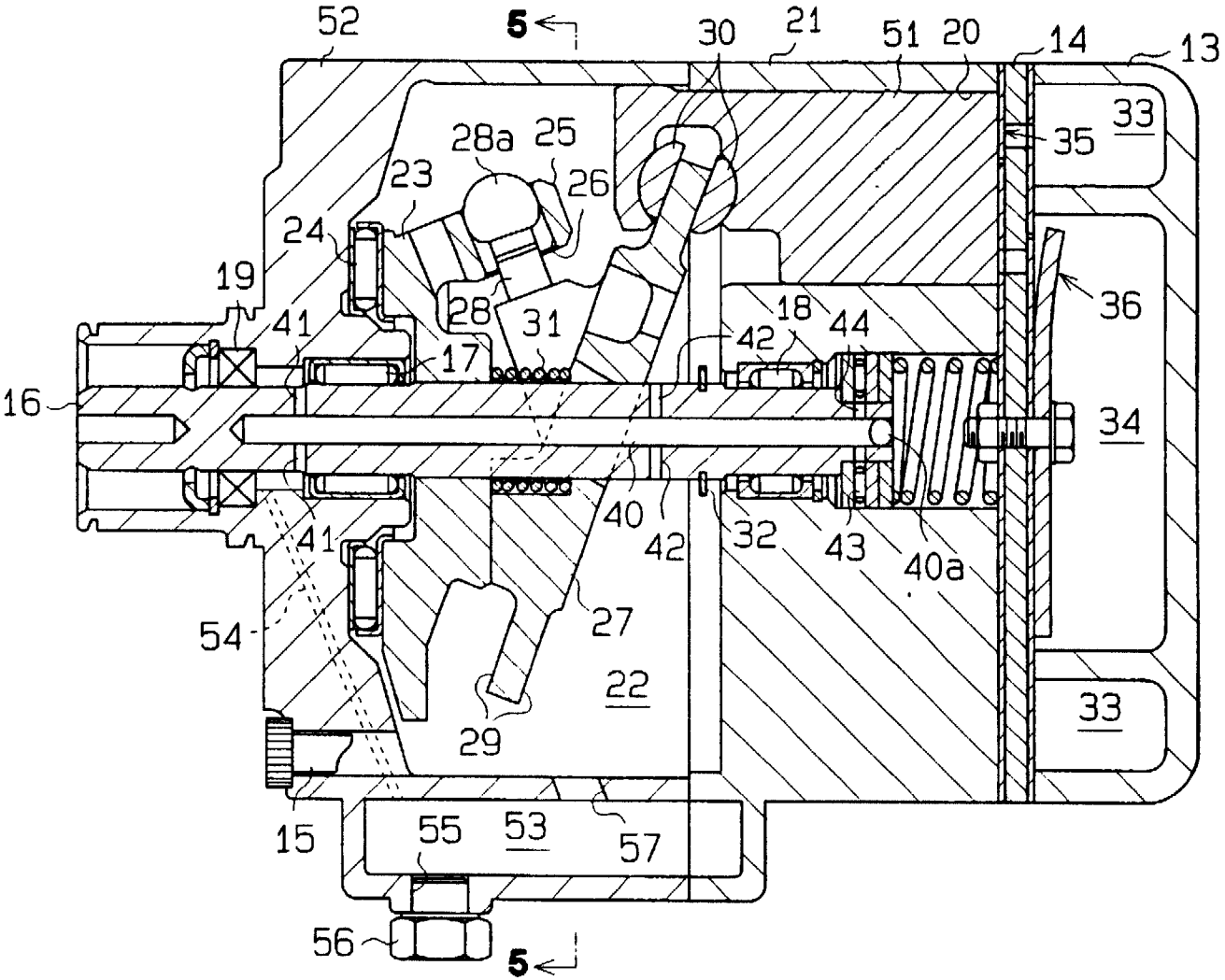
FIG. 4 is a cross-sectional top view of a piston type compressor according to a second embodiment of the present invention.
Figure 5:
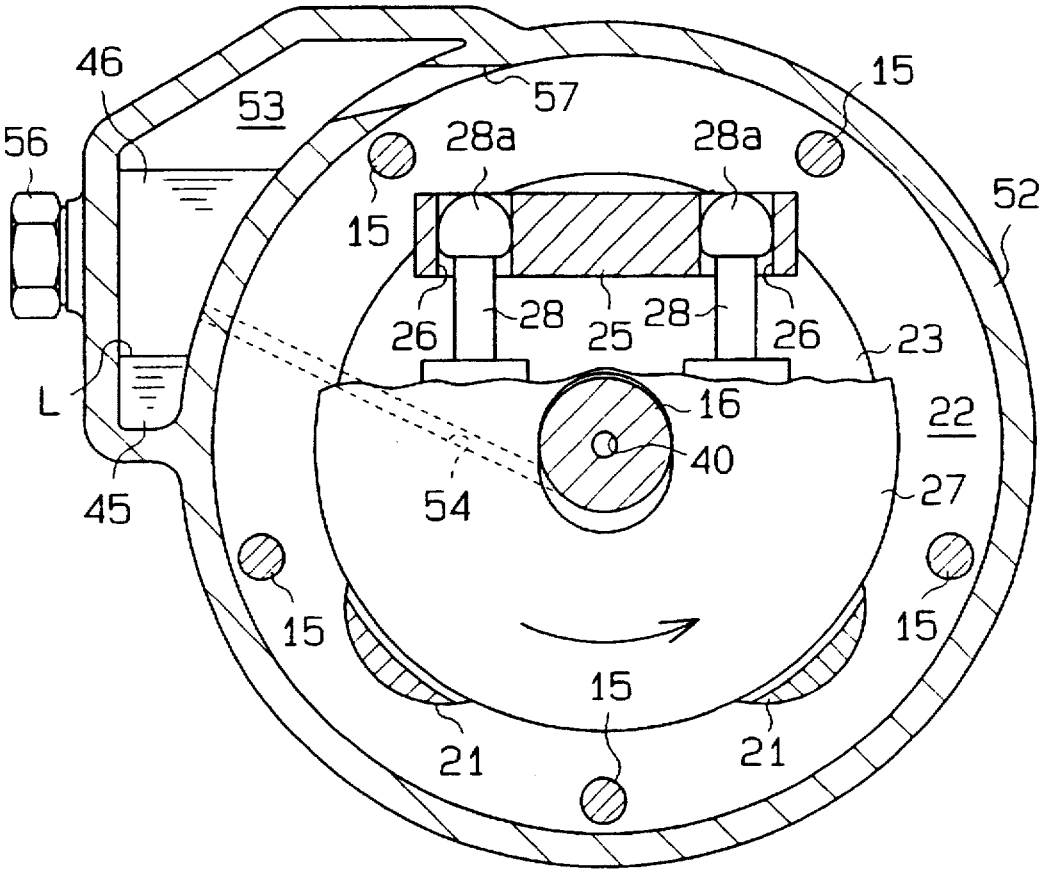
FIG. 5 is a cross-sectional view as seen from the plane indicated by line 5—5 in FIG. 4.
Figure 6:
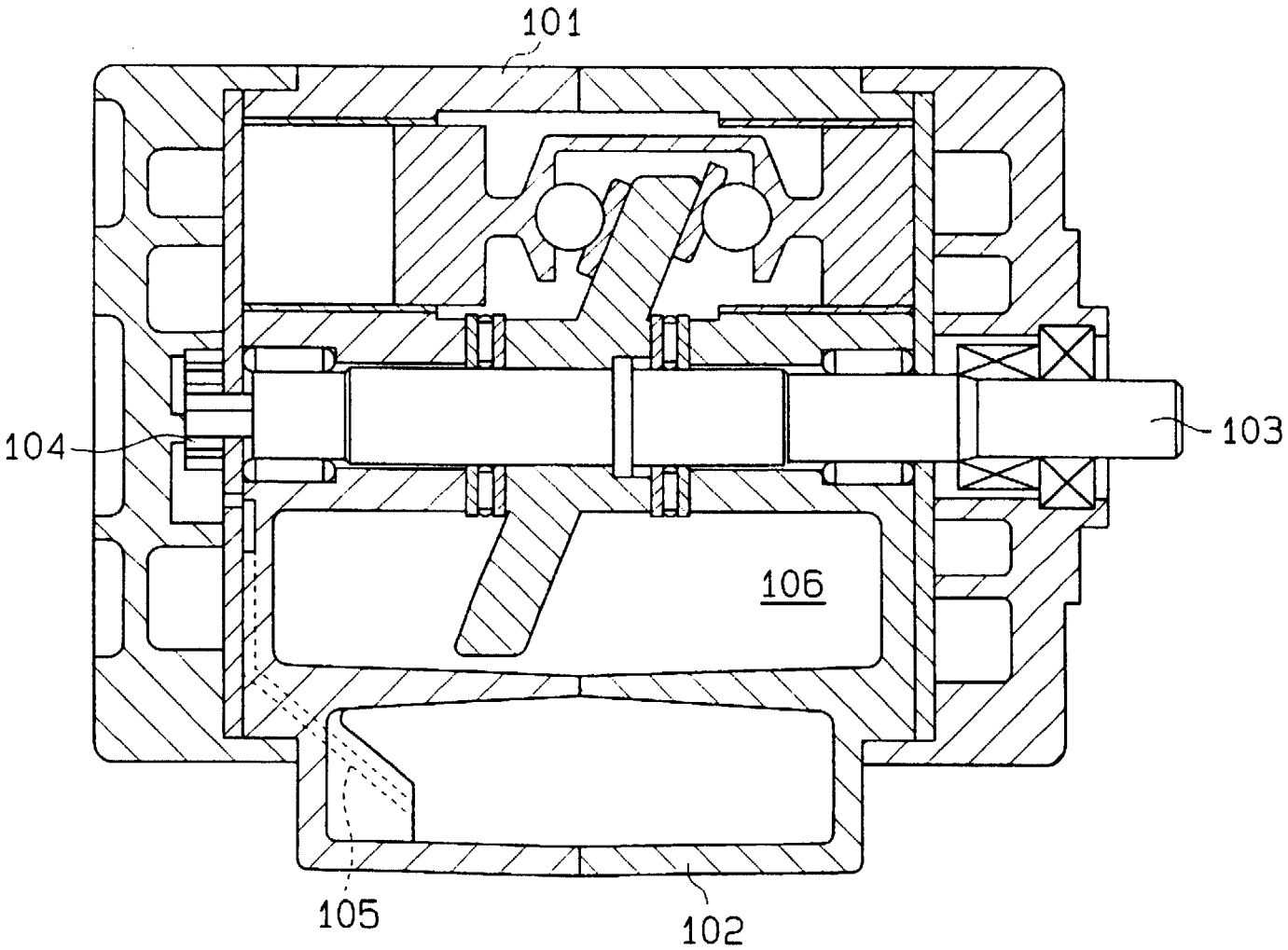
Fig.6(Prior Art)
FIG. 6 is a cross-sectional side view of a prior art compressor.

Another embodiment according to the present invention will now be described centering on the parts differing from the first embodiment. As shown in FIG. 4, a cylinder block 51 and a front housing 52 are coupled to each other at the middle section of the casing. As shown in FIG. 5, an oil pan 53 is defined extending upward from the side of the casing. A first lubricating passage 54 extends inclined toward the vicinity of the drive shaft 16 in the front housing 52 from the oil pan 53.

As shown in FIG. 4, the oil pan 53 is provided with a plug hole 55. The hole 55 is formed in the outer wall of the oil pan 53 along the axis of the first lubricating passage 54. The hole 55 is closed by a plug 56. An aperture 57 is provided in the partition wall between the crank chamber 22 and the oil pan 53 at an upper section.

The structure of the second embodiment enables the first passage 54 to be formed through the hole 55 by a drill or the like before closing it with the plug 54. In addition, the collecting position of the lubricating oil 46 in the oil pan 53 is located at a position much higher than the position of the outlet of the first lubricating passage 54 at the side of the shaft 16. This enhances the supply of lubricating oil, which utilizes gravitational force.

What is claimed is:

1. A compressor for a refrigeration system that circulates a refrigerant mixed with oil, the compressor comprising:

a casing;

a crank chamber within the casing, the crank chamber having a wall, wherein the crank chamber is supplied with the mixture of refrigerant and oil, the crank chamber having a bottom at which liquefied refrigerant and oil may settle due to gravity under certain conditions;

a drive shaft mounted in a rotatable manner to the casing for driving the compressor;

a cam plate connected to and driven by the drive shaft and located within the crank chamber, wherein rotation of the cam plate throws oil against the wall and causes oil to flow along the wall of the crank chamber in the general direction of rotation of the cam plate during operation of the compressor;

a cylinder bore formed within the casing;

a piston located within the bore, wherein the piston is coupled to the cam plate such that the cam plate causes the piston to reciprocate within the bore, which serves to compress the refrigerant and to discharge the refrigerant and oil mixture from the compressor;

an oil pan externally connected to and communicating with the crank chamber for collecting oil from the crank chamber, wherein the oil pan is located at a position elevated from the bottom of the crank chamber;

an oil recovering passage for joining the oil pan with the crank chamber such that some of the oil flowing along the wall of the crank chamber enters the recovering passage and thus enters the oil pan;

an oil guide passage for guiding oil from the oil pan toward a location near the drive shaft by the force of gravity on the oil.

2. The compressor according to claim 1, wherein the oil pan has a bottom at which liquids may settle, and wherein the guide passage includes a first end connected with the oil pan and a second end having an outlet near the drive shaft, and wherein liquefied refrigerant and oil tend to collect at the bottom of the oil pan such that liquid refrigerant settles lower than oil due to its greater specific gravity, and wherein the first end of the guide passage has an inlet open to the oil pan at a location above and spaced from the bottom to the oil pan such that the inlet is normally located above the level of the settled refrigerant and such that mostly only oil enters the first end of the guide passage.

3. The compressor according to claim 1, wherein the recovering passage is inclined to be directed toward the flow of oil along the wall of the crank chamber to facilitate entry of the oil into the oil pan.

4. The compressor according to claim 1, wherein the cross sectional area of the recovering passage is larger than the cross sectional area of the guide passage.

5. A piston type compressor for a refrigeration system that circulates a refrigerant mixed with oil, the compressor comprising:

a casing;

a crank chamber within the casing, the crank chamber having a wall surrounding and defining the crank chamber, wherein the crank chamber is supplied with the mixture of refrigerant and oil, the crank chamber having a bottom at which oil may settle due to gravity;

a drive shaft mounted in a rotatable manner to the casing for driving the compressor;

a cam plate connected to and driven by the drive shaft and located within the crank chamber, wherein rotation of the cam plate throws oil against the wall and causes oil to flow along the wall of the crank chamber during operation of the compressor;

a cylinder bore formed within the casing;

a piston located within the bore, wherein the piston is coupled to the cam plate such that the cam plate causes the piston to reciprocate within the bore, which serves to compress the refrigerant and to discharge the refrigerant and oil mixture from the compressor;

an oil pan externally connected to the casing of the compressor at a position elevated from the bottom of the crank chamber for collecting oil from the crank chamber, wherein the oil pan forms a chamber separate from the crank chamber;

an oil recovering passage for joining the interior of the oil pan with the interior of the crank chamber such that some of the oil flowing along the wall of the crank chamber enters the recovering passage and thus enters the oil pan, wherein the oil recovering passage opens to the crank chamber at a location above and spaced from the bottom of the crank chamber;

an oil guide passage for guiding oil from the oil pan toward a location near the drive shaft by the force of gravity on the oil.

6. The compressor according to claim 5, wherein the oil pan has a bottom at which liquids may settle, and wherein the guide passage includes a first end connected with the oil pan and a second end having an outlet near the drive shaft, and wherein liquefied refrigerant and oil tend to collect at the bottom of the oil pan such that liquid refrigerant settles lower than oil due to its greater specific gravity, and wherein the first end of the guide passage has an inlet open to the oil pan at a location above and spaced from the bottom to the oil pan such that the inlet is normally located above the level of the settled refrigerant and such that mostly only oil enters the first end of the guide passage.

7. The compressor according to claim 5, wherein the recovering passage is inclined to be directed toward the flow of oil along the wall of the crank chamber to facilitate entry of the oil into the oil pan.

8. The compressor according to claim 5, wherein the cross sectional area of the recovering passage is larger than the cross sectional area of the guide passage.

9. The compressor according to claim 5, wherein an oil supply passage is formed inside the drive shaft and is connected to the guide passage to receive oil from the guide passage, wherein the oil supply passage directs oil to the cam plate.

10. The compressor according to claim 5 further comprising:

a front radial bearing for supporting a front end of the drive shaft;

a seal for sealing between the front end of the drive shaft and the casing;

a space formed between the seal and the front radial bearing, wherein oil is supplied to the space by the guide passage.

11. The compressor according to claim 5 further comprising:

a front radial bearing for supporting a front end of the drive shaft;

a seal for sealing between the front end of the drive shaft and the casing;

a space formed between the seal and front radial bearing, wherein the outlet of the guide passage opens into the space to supply oil to the space.

12. The compressor according to claim 11, wherein an oil supply passage is formed inside the drive shaft and is connected to the space for receiving oil from the space.

13. The compressor according to claim 5 further comprising:

a rear bearing for supporting the rear end of the drive shaft;

an oil supply passage formed inside the drive shaft and connected to the guide passage for receiving oil from the guide passage, such that the oil supply passage directs oil to the rear bearing.

14. The compressor according to claim 5, wherein the oil recovering passage is located near the top of the oil pan.

15. A piston type compressor for a refrigeration system that circulates a refrigerant mixed with oil, the compressor comprising:

a casing;

a crank chamber within the casing, the crank chamber having a wall surrounding and defining the crank chamber, wherein the crank chamber is supplied with the mixture of refrigerant and oil, the crank chamber having a bottom at which oil may settle due to gravity;

a drive shaft mounted in a rotatable manner to the casing for driving the compressor;

a cam plate connected to and driven by the drive shaft and located within the crank chamber, wherein rotation of the cam plate throws oil against the wall and causes oil to flow along the wall of the crank chamber generally in the direction of rotation of the cam plate during operation of the compressor;

a cylinder bore formed within the casing;

a piston located within the bore, wherein the piston is coupled to the cam plate such that the cam plate causes the piston to reciprocate within the bore, which serves to compress the refrigerant and to discharge the refrigerant and oil mixture from the compressor;

an oil pan connected to the side of the casing of the compressor for collecting oil from the crank chamber, wherein the oil pan forms a chamber separate from the crank chamber, and wherein the oil pan has a bottom at which liquids may settle;

an oil recovering passage for joining the interior of the oil pan with the interior of the crank chamber such that some of the oil flowing along the wall of the crank chamber enters the recovering passage and thus enters the oil pan, the oil recovering passage having an inlet and an outlet, the outlet being located near the top of the oil pan and the inlet being open to the crank chamber at a location above and spaced from the bottom of the crank chamber;

an oil guide passage for guiding oil from the oil pan toward a location near the drive shaft by the force of gravity on the oil, wherein the guide passage includes a first end connected with the oil pan and a second end having an outlet near the drive shaft, and wherein liquefied refrigerant and oil tend to collect at the bottom of the oil pan such that liquid refrigerant settles lower than oil due to its greater specific gravity, and wherein the first end of the guide passage has an inlet open to the oil pan at a location above and spaced from the bottom to the oil pan such that the inlet is normally located above the level of the settled refrigerant and such that mostly only oil enters the first end of the guide passage.

16. The compressor according to claim 15, wherein the recovering passage is inclined to be directed toward the flow of oil along the wall of the crank chamber to facilitate entry of the oil into the oil pan.

17. The compressor according to claim 15, wherein the cross sectional area of the recovering passage is larger than the cross sectional area of the guide passage.

* * * * *

UNITED STATES PATENT AND TRADEMARK OFFICE

CERTIFICATE OF CORRECTION

PATENT NO. : 5,779,004
DATED : July 14, 1998
INVENTOR(S) : T. Hoshino et al.

It is certified that error appears in the above-identified patent and that said Letters Patent is hereby corrected as shown below:

Column 6, line 15, change last word "forces" to --force--.

Column 7, line 4, change "such" to --Such--.

Signed and Sealed this

Fifteenth Day of December, 1998

Bruce Lehman

*Attest:*

BRUCE LEHMAN

*Attesting Officer*

*Commissioner of Patents and Trademarks*